US006662519B2

(12) United States Patent
Chung

(10) Patent No.: US 6,662,519 B2
(45) Date of Patent: Dec. 16, 2003

(54) WOODEN NEWEL POST

(76) Inventor: Pei-Chiang Chung, 3F, No. 21, Lane 83, Jung-Hsin St., Tan-Tze Hsiang, Taichung Hsien (TW)

( * ) Notice: Subject to any disclaimer, the term of this patent is extended or adjusted under 35 U.S.C. 154(b) by 0 days.

(21) Appl. No.: 10/113,597

(22) Filed: Apr. 2, 2002

(65) Prior Publication Data

US 2003/0182892 A1 Oct. 2, 2003

(51) Int. Cl.[7] ..... E04C 3/30

(52) U.S. Cl. ..... 52/720.2; 52/730.7; 428/535; 428/537.1

(58) Field of Search ..... 52/730.7, 720.2; 428/537.1, 535

(56) References Cited

U.S. PATENT DOCUMENTS 400,470 A * 4/1889 Marshall ..... 52/184
688,603 A * 12/1901 De Walt ..... 52/731.4
2,824,342 A * 2/1958 Hoyle, Jr. ..... 52/726.4
2,834,073 A * 5/1958 Hoyle, Jr. ..... 52/726.4
4,387,546 A * 6/1983 Kurita et al. ..... 52/730.7
4,413,459 A * 11/1983 Lambuth ..... 52/729.4
4,624,295 A * 11/1986 Howland ..... 144/347
4,655,017 A * 4/1987 Bond ..... 52/187
5,035,401 A * 7/1991 Solter ..... 256/19
5,626,331 A * 5/1997 Erwin ..... 256/59
6,025,053 A * 2/2000 Grenier ..... 428/172
6,115,985 A * 9/2000 Wu ..... 52/720.2
6,240,698 B1 * 6/2001 Chung ..... 52/720.2

* cited by examiner

*Primary Examiner*—Ramon O. Ramirez
*Assistant Examiner*—Amy J. Sterling
(74) *Attorney, Agent, or Firm*—Lowe Hauptman Gilman & Berner, LLP

(57) ABSTRACT

A wooden newel post includes upper and lower post sections, anda decorative lamella layer. The upper post section is made of higher quality wood, and has a lower post connecting end. The lower post section is made of lower quality wood, and has an upper post connecting end connected to the lower post connecting end of the upper post section, and an outer post surface. The decorative lamella layer is made of higher quality wood, and is secured to the outer post surface of the lower post section.

8 Claims, 5 Drawing Sheets

WOODEN NEWEL POST

BACKGROUND OF THE INVENTION

1. Field of the Invention

The invention relates to a wooden newel post and, more particularly to a wooden newel post that is made from a combination of higher and lower quality wood materials.

2. Description of the Related Art

Referring to FIGS. 1 and 2, a conventional wooden newel post 1 is shown to have a height and width, and is formed by interconnecting three wooden boards 101 side-by-side along the width of the wooden newel post 1 to form a rectangular raw post body. Each of the wooden boards 101 is made of higher quality wood, such as oak or maple, and extends the full height of the wooden newel post 1. The post body is turned so as to form a contoured upper post section 2, and a lower post section 3 having a rectangular cross-section. The standard specification of the wooden newel post 1 is 43 to 72 inches in height. Higher quality wood materials having no scars, no mineral lines, and having sufficient length are selected to produce the conventional wooden newel post 1.

SUMMARY OF THE INVENTION

The main object of the present invention is to provide a wooden newel post that is made from a combination of higher and lower quality wood materials so as to help reduce consumption of higher quality wood.

According to this invention, a wooden newel post having a height and width comprises an upper post section, a lower post section, and a decorative lamella layer. The upper post section is made of higher quality wood, and has a lower post connecting end. The lower post section is made of lower quality wood, and has an upper post connecting end connected to the lower post connecting end of the upper post section, and an outer post surface. The decorative lamella layer is made of higher quality wood, and is secured to the outer post surface of the lower post section.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION

Figure 1:
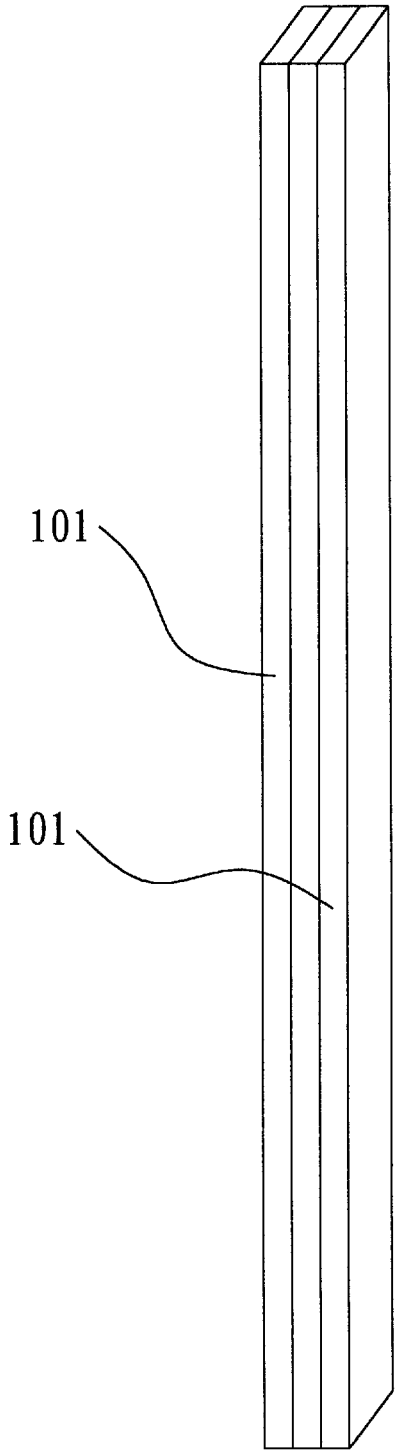
FIG. 1 PRIOR ART
FIG. 1 illustrates how a conventional wooden newel post is made from a plurality of wooden boards.
Figure 2:
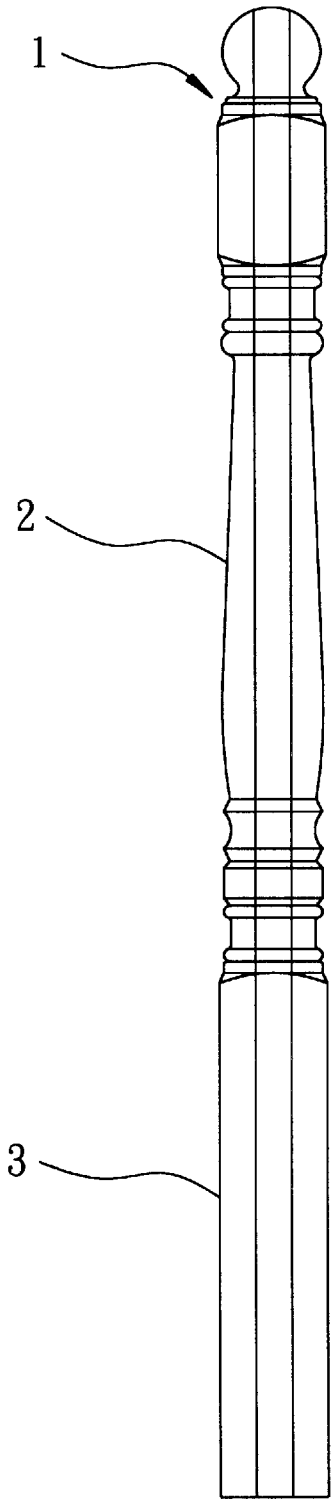
FIG. 2 PRIOR ART
FIG. 2 is a schematic view of the conventional wooden newel post.

Referring to FIGS. 3 to 6, one preferred embodiment of a wooden newel post 100 according to the present invention is shown to have a height and width, and comprises an upper post section 10, a lower post section 20 connected to the upper post section 10, and a decorative lamella layer 30 adhered to an outer post surface of the lower post section 20.

The upper post section 10 is made of hard higher quality wood, such as oak wood and maple wood, and extends at least one-half of the full height of the wooden newel post 100. In this embodiment, the upper post section 10 extends to approximately two-thirds of the full height of the wooden newel post 100, and has a top end portion 11, a lower post connecting end 12 opposite to the top end portion 11, and a contoured outer post surface 13 that extends along the full height of the upper post section 10. The upper post section 10 includes three wooden boards 14 that are interconnected side-by-side along the width of the wooden newel post 100, such as by gluing, and that extend along the full height of the uppermost section 10. Lower ends 141 of the wooden boards 14 correspond to the lower post connecting end 12 of the upper post section 10.

The lower post section 20 is made of lower quality wood, such as rubber wood and pine wood from plantation forests, defective higher quality wood, and high density fiber material. The lower post section 20 has a rectangular cross-section, an upper post connecting end 21, a bottom end portion 22 opposite to the upper post connecting end 21, and an outer post surface 23 that extends along the full height of the lower post section 20. The lower post section 20 includes three wooden boards 24 that are interconnected side-by-side along the width of the wooden newel post 100, such as by gluing, and that extend along the full height of the lower post section 20. Upper ends 241 of the wooden boards 24 correspond to the upper post connecting end 21. Each wooden board 24 includes two board sections 24' that are interconnected to each other along the full height of the lower post section 20 by means of finger joints. The upper ends 241 of the wooden boards 24 of the lower post section 20 and the lower ends 141 of the wooden boards 14 of the upper post section 10 are interconnected by means of finger joints, such that the lower post section 20 extends continuously from the upper post section 10 along the full height of the wooden newel post 100.

The decorative lamella layer 30 includes 2–8mm lamella pieces of the same hard higher quality wood used in the upper post section 10, and is adhered securely to the outer post surface 23 on four sides of the lower post section 20.

Figure 6:
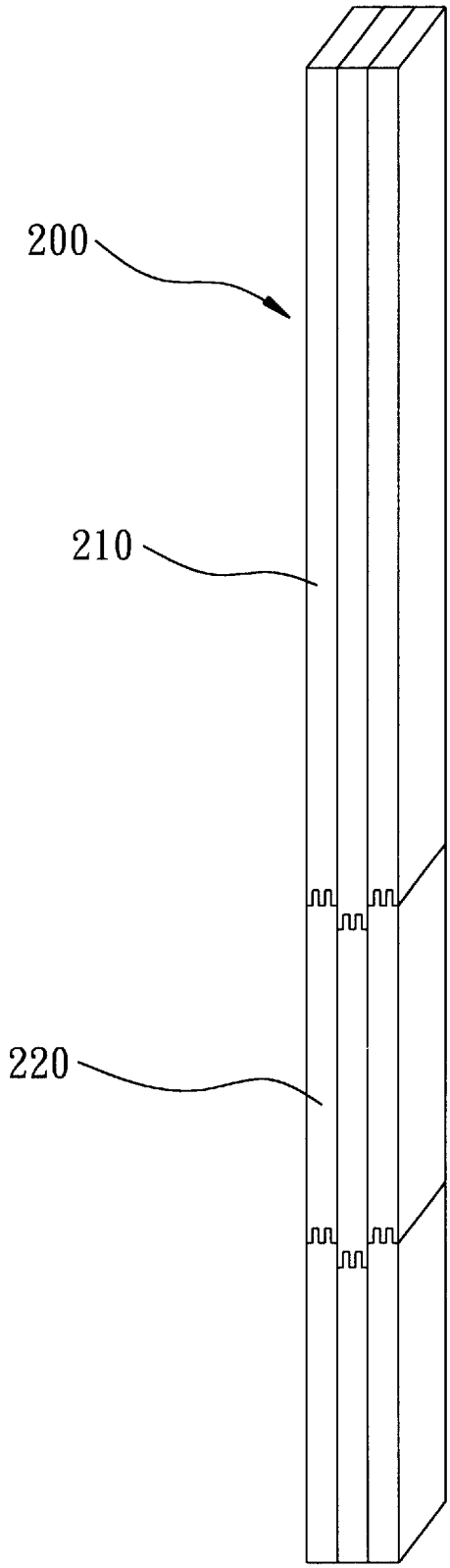
FIG. 6 is a perspective view of a rectangular raw post body of the preferred embodiment, illustrating how the wooden newel post is made from the post body.

Referring to FIG. 6, the wooden newel post 100 of this invention is manufactured according to a process that is substantially similar to the conventional one. Three wooden boards 210 made of higher quality wood are interconnected respectively with three wooden boards 220 made of lower quality wood so as to form a rectangular raw post body 200. The post body 200 is lathed so as to form the contoured outer post surface 13 of the upper post section 10.

Figure 3:
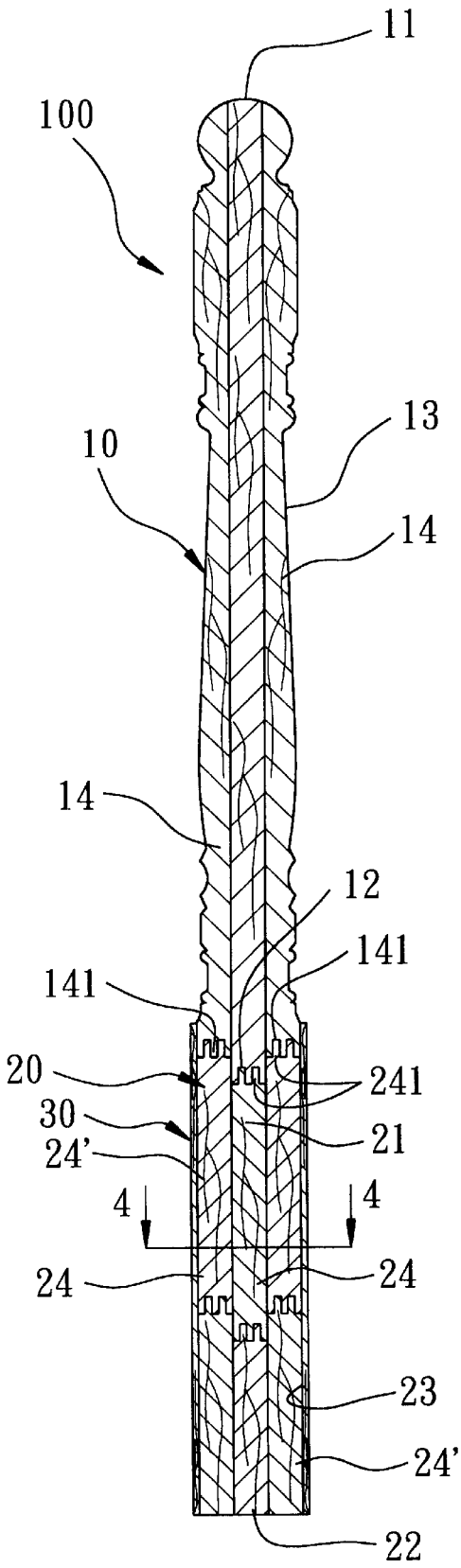
FIG. 3 is a schematic cross-sectional view of the preferred embodiment of a wooden newel post according to the present invention.
Figure 4:
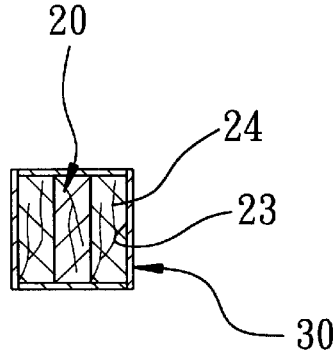
FIG. 4 is a cross-sectional view of the preferred embodiment taken along line 4—4 of FIG. 3.
Figure 5:
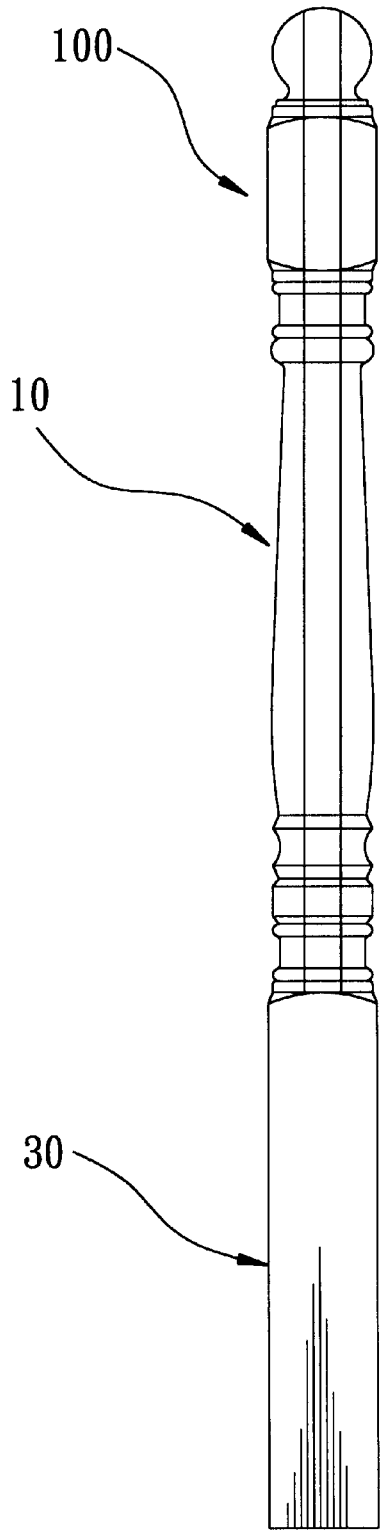
FIG. 5 is a schematic view of the wooden newel post of the present invention.

Although the wooden newel post 100 of the present invention conveys a continuous higher quality wood appearance in view of the upper post section 10 and the decorative lamella layer 30, as best illustrated in FIGS. 3 and 5, the lower post section 20 covered by the decorative lamella layer 30 can be made of lower quality wood or defective higher quality wood, thereby reducing consumption of higher quality wood material to a minimum.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A wooden newel post having a height and width, comprising:

an upper newel post section made of higher quality wood and having a lower newel post connecting end, the higher quality wood selected from the group consisting of oak wood and maple wood;

a lower post section made of lower quality wood and having an upper newel post connecting end connected to said lower post connecting end of said upper newel post section, said lower newel post section further having an outer newel post surface, the lower quality wood selected from the group consisting of rubber wood and pine wood from plantation forests, defective higher quality wood, and high density fiber material; and a decorative lamella layer made of higher quality wood and secured to said outer newel post surface of said lower post section.

2. The wooden newel post as claimed in claim 1, wherein said upper post section extends at least one-half of the full height of said wooden newel post.

3. The wooden newel post as claimed in claim 1, wherein said upper post section has a contoured outer post surface.

4. The wooden newel post as claimed in claim 1, wherein said upper post section includes a plurality of wooden boards that are interconnected side-by-side along the width of said wooden newel post, and that extend along the full height of said upper post section.

5. The wooden newel post as claimed in claim 1, further comprising finger joint means provided on said lower post connecting end and said upper post connecting end for interconnecting said upper and lower post sections.

6. The wooden newel post as claimed in claim 1, wherein said lower post section includes a plurality of wooden boards that are interconnected side-by-side along the width of said wooden newel post, and that extend along the lull height of said lower post section.

7. The wooden newel post as claimed in claim 6, wherein each of said wooden boards includes a plurality of board sections that are interconnected to each other by means of finger joints.

8. The wooden newel post as claimed in claim 1, wherein said lower post section has a rectangular cross-section, and said decorative lamella layer is secured to four sides of said lower post section.

* * * * *